US005196985A

United States Patent [19]

Ford et al.

[11] Patent Number: 5,196,985

[45] Date of Patent: Mar. 23, 1993

[54] STATIC-CONDUCTIVE WRIST BAND

[75] Inventors: Randolph J. Ford; Bob Delturco, both of Tucson, Ariz.

[73] Assignee: Bystat, Inc., Ville St-Laurent, Canada

[21] Appl. No.: 763,648

[22] Filed: Sep. 23, 1991

[51] Int. Cl.[5] ..... H05F 3/02

[52] U.S. Cl. ..... 361/220; 361/212

[58] Field of Search ..... 361/212, 220

[56] References Cited

U.S. PATENT DOCUMENTS

| | | | |
|---|---|---|---|
| 3,857,397 | 12/1974 | Brosseau | 361/220 |
| 4,459,633 | 7/1984 | Vandermark | 361/220 |
| 4,475,141 | 10/1984 | Antonevich | 361/220 |
| 4,577,256 | 3/1986 | Breidegam | 361/220 |
| 4,847,729 | 7/1989 | Hee | 361/220 |
| 5,036,423 | 7/1991 | Williams | 361/212 |

*Primary Examiner*—Jeffrey A. Gaffin

*Attorney, Agent, or Firm*—Fishman, Dionne & Cantor

[57] ABSTRACT

A static-conductive wrist band is presented. The static-conductive wrist band has an electrically non-conductive surface opposed by an electrically conductive surface. A connector is disposed on the non-conductive surface and is in electrical contact with the electrically conductive surface. A ground strap may be connected from the connector on the wrist band to a suitable ground, thereby discharging and prohibiting static buildup on the wearer. In accordance with an important feature of this invention, the wrist band comprises a spring consisting of a resilient strip which can be converted from a self supporting elongated configuration to an axially coiled configuration. The spring provides the means for retaining the strap about a wearer's wrist.

31 Claims, 3 Drawing Sheets

STATIC-CONDUCTIVE WRIST BAND

BACKGROUND OF THE INVENTION

This invention relates to static-conductive straps or bands. More particularly, this invention relates to a resilient static-conductive wrist band which may be easily converted between a self-supporting elongated configuration and an axially coiled configuration.

Static-conductive wrist straps or bands are well known in the art and find particular utility in the electronics assembly field where static electricity may cause serious damage to electronic components. These wrist bands are generally comprised of a fabric which is wrapped around a wrist and secured by a buckle or a loop-hook (Velcro) type attachment. Such an attachment provides means for adjusting the straps to assure a proper fit about the wearer's wrist. Fabric bands may also include elastic and be slid onto the wrist (rather than wrapped around the wrist) and therefore secured by the elastic feature.

In order to conduct static electricity away from the wearer, each of the fabric type wrist straps or bands include a conductive metal element secured on the inner surface of the fabric so as to come in contact with the wearer's skin. Alternatively, the required electrical contact is provided when the inner surface of the fabric is comprised of a conductive fiber (e.g., silver fibers) which are interwoven with the fabric. Some static-conductive wrist straps incorporate both the conductive element and the conductive fibers. The conductive element and/or conducted fibers are connected to a suitable ground. This connection generally employs a snap connector in electrical connection with the conductive element or conductive fibers with the snap connector being permanently afixed to the strap. A wire (i.e., a ground cord) is connected to the snap connector at one end and to the ground at the other end. Thus, any static charge built-up on the wearer is discharged to the ground by the wrist strap via the ground cord. The ground cord typically has a built-in current limiting resistor to prevent electrical shocks to the wearer.

While well suited for its intended purposes, prior art static-conductive wrist straps do suffer from certain drawbacks and deficiencies. For example, the fabric from the wrist straps will wear over time and generate particulates which are undesirable in areas such as "clean rooms" commonly found in the electronics industry. In the case of elastic wrist straps, the elastic straps tend to lose their elastic characteristics over time. Still another drawback of prior art devices is related to the safety of such devices. A wide variety of machines are used in electronics manufacturing, many of which are in areas where these static-conductive wrist straps are employed. If the wrist strap becomes caught in one of these machines while the machine is in operation and while the wrist strap is being worn, injury may result since the strap is not easily (i.e., quickly) removed from the wearer's wrist.

SUMMARY OF THE INVENTION

The above-discussed and other drawbacks and deficiencies of the prior art are overcome or alleviated by the static-conductive wrist strap of the present invention. In accordance with the present invention, the static-conductive wrist strap comprises a resilient strip having an electrically conductive surface and a snap connector in contact with the electrically conductive surface. In accordance with a preferred embodiment, the electrically conductive surface comprises a surface of the resilient strip (in which case the entire strip is comprised of electrically conductive material). In accordance with an alternate embodiment, the resilient strip is covered by a sleeve, one side (i.e., the electrically conductive surface) of which has conductive fibers interwoven therewith or which is treated with an electrically conductive ink.

In accordance with still another embodiment, the resilient strip is coated on one surface (i.e., the electrically conductive surface) with an electrically conductive ink.

During use, the strap is coiled around a wrist or ankle so that the electrically conductive surface is in contact with the wearer's skin. The opposing surface of the strap is covered with a non-conductive material (e.g., vinyl sheath). A ground cord (a wire typically having a built-in current limiting resistor) is connected to the snap connector at one end and to a suitable ground at the other end. Static electricity associated with the wearer is easily transferred to the conductive surface of the strap and then travels from the snap connector to the ground cord.

In accordance with an important feature of the present invention, the resilient strap comprises spring means which may be converted between a spirally coiled configuration and a self supporting axially extended configuration. The spring means comprises an elongated resilient strip of substantially uniform width and thickness and includes opposed top and bottom surfaces. In the extended configuration the strip exhibits a concavo-convex profile. In the coiled configuration the strip exhibits a rectilinear profile.

The present invention includes many significant features and advantages relative to prior art devices. For example, the present invention is easily and quickly secured about a wearer's wrist by firmly tapping the resilient strap (when it is an elongated position) against the wrist and then releasing the other end. The ground cord is then attached to the snap connector. The resilient strap of the present invention will pull off the wearer's wrist if caught (e.g., in a machine while in operation), thus reducing the possible injury to the wearer, as may occur with the prior art straps. The resilient strap of the present invention is self adjusting and fits a wide variety of sizes. The present invention requires less tension to assure contact between the static-conductive surface and the wearer's skin, than is required in prior art devices. Unlike prior art devices, the present invention will not relax over time, thus always assuring a proper fit. The resilient strap of the preferred embodiment of this invention is well suited for "clean room" environments since it will not produce particulates as does the prior art cloth devices. It will be appreciated that the static-conductive wrist straps of this invention will employ the same grounding cords as do the prior art devices and are therefore interchangeable therewith.

The above-discussed and other features and advantages of the present invention will be appreciated and understood b those skilled in the art from the following detailed description and drawings.

BRIEF DESCRIPTION OF THE DRAWINGS

Referring now the the drawings, wherein like elements are numbered alike in the several FIGURES.

DESCRIPTION OF THE PREFERRED EMBODIMENT

Figure 1:
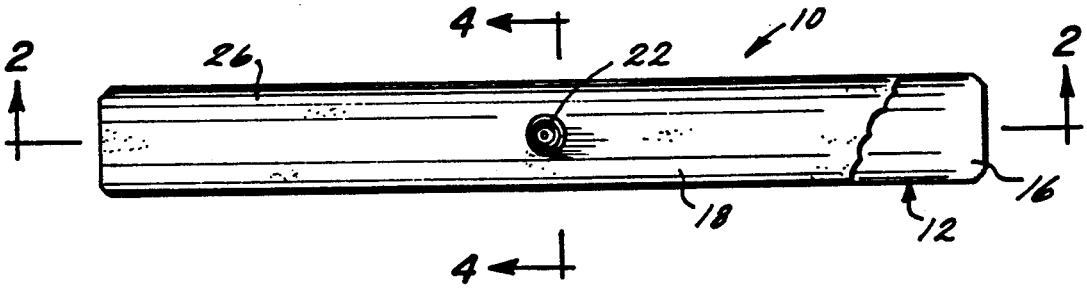
FIG. 1 is a top view of a static-conductive strap in a self supporting axially extending position, partially broken away to show underlying structure, in accordance with a first embodiment of the present invention.
Figure 2:
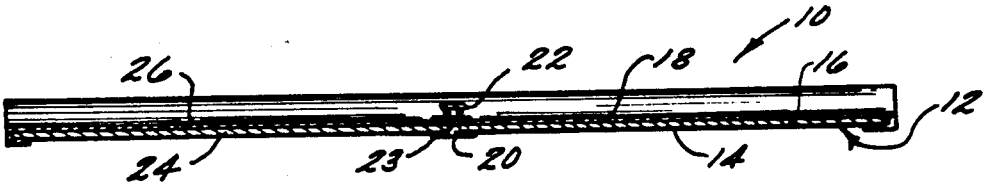
FIG. 2 is a longitudinal cross sectional view taken along the line 2—2 of FIG. 1.
Figure 3:
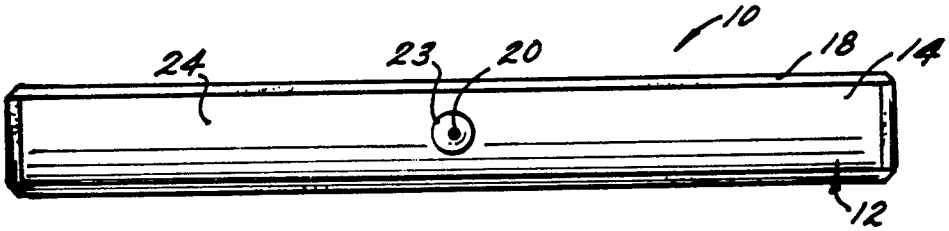
FIG. 3 is bottom view of the static-conductive strap of FIG. 1.

Referring to FIGS. 1-5, a static-conductive wrist strap in accordance with the present invention is shown generally at 10. In a first embodiment, strap 10 comprises an elongated resilient electrically conductive strip 12 of substantially uniform width and thickness and having a bottom surface 14 and a top surface 16. An electrically insulating material 18 covers the top surface 16 and wraps around the edges of strip 12 also covering the periphery of bottom surface 14. Insulating material 18 is preferably comprised of a vinyl sheath which is secured to surfaces 12 and 14 by a suitable adhesive. However, insulating material 18 may also be composed of any other suitable insulating material including plastic films and woven fabrics of known types. An aperture 20 through strip 12 and cover 18 provides means for attaching a snap connector 22 (e.g., a protuberant snap connector). Connector 22 is electrically conductive and is in contact with surface 14 of strip 12 at a circular area designated 23. In an axially extending configuration, the strap 10 extends axially and, in a transverse cross sectional view (FIG. 4), exhibits a concavo-convex curvilinear profile. Bottom surface 24 exhibits a convex profile and top surface 26 exhibits a concave profile.

When fully extended, strap 10 will remain in the extended configuration even if unrestrained, i.e., strap 10 is self supporting. In the coiled configuration, strap 10 is coiled on itself in a spiral coil and, in a side view of a turn of the coiled strap 10, strap 10 exhibits a rectilinear profile wherein the top and bottom surfaces 24, 26 of strap 10 are each flat. When strap 10 is in the coiled configuration, the bottom surface 24 of strap 10 faces radially inwardly. Strap 10 may be contracted from the extended position (FIGS. 1-4) into the coiled position (FIG. 5) by compressing or bending strap 10 at a point along its length so that the cross sectional profile of strap 10 at the point of compression approaches a rectilinear profile, i.e. flat, parallel top and bottom surfaces 26, 24. The deformation propagates along the length of strap 10 in both directions from the point of compression whereby the full length of strap 10 is rapidly and forcefully brought into the coiled position (FIG. 5), i.e. strap 10 is self coiling once triggered. The coiling of strap 10 is easily accomplished by the wearer hitting the extended strap on the wrist or ankle whereupon the strap will coil as shown in FIG. 5.

Figure 4:
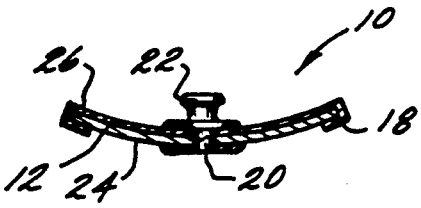
FIG. 4 is a transverse cross sectional view taken along the line 4—4 of FIG. 1.

Strap 10 may be extended from the coiled position (FIG. 5) into the extended position (FIGS. 1-4) by uncoiling strap 10 so that strap 10 exhibits the concavo-convex cross sectional profile (as best shown in FIG. 4) at each point along its length. This is easily accomplished by uncoiling the strap until it approaches its self supporting profile whereupon it will resume its concavo-convex cross sectional profile.

Preferably, strip 12 comprises a metal and, most preferably, strip 12 comprises steel. A flat stock of 301 stainless steel having a Rockwell hardness between about 48 and 51 has been found to be particularly well suited for use in making strip 12. The spring (i.e., strip 12) is a "self coiling" spring made substantially according to conventional methods as described in the description of FIG. 6 in U.S. Pat. No. 3,006,400, the disclosure of which is incorporated herein by reference.

Figure 5:
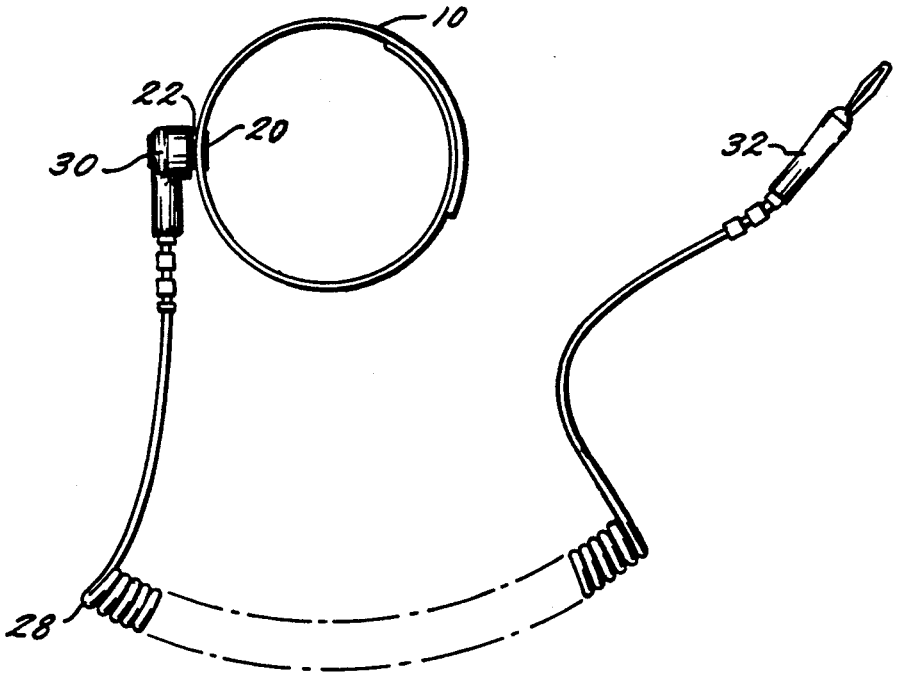
FIG. 5 is a side view of the present invention in a spirally coiled position with a wire for grounding attached thereto.

Referring to FIG. 5, a ground cord 28 having a mating snap connector 30 (i.e., a detent snap connector) is connected to strap 10 by snap connector 22. Cord 28 is well known in the art and generally includes a built-in current limiting resistor to prevent electrical shocks to wearer. At the other end of cord 28 is a connector 32 for connection to a suitable ground for preventing static charge buildup on the wearer. The path for static discharged is from the wearer's skin to surface 14 (surface 14 is in contact with the wearer when strap 10 is worn about the wrist, ankle or other suitable exposed body part of the wearer), then via connector 22 to cord 28 and finally to a ground (cord 28 is to be connected to the ground).

Figure 6:
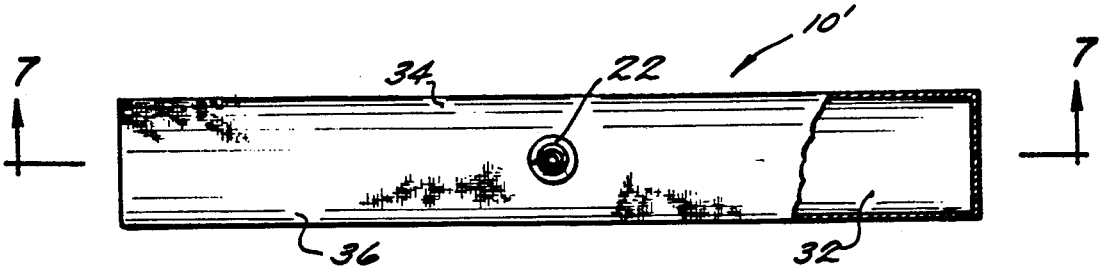
FIG. 6 is a top view of the static-conductive strap in a self supporting axially extending position, partially broken away to show underlying structure, in accordance with a second embodiment of the present invention.
Figure 7:
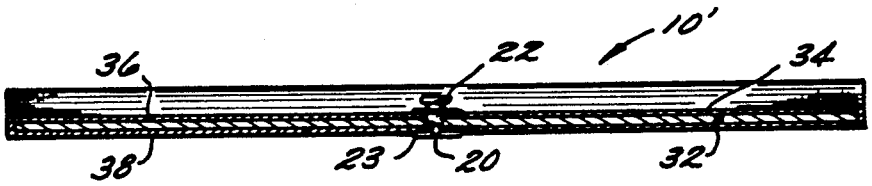
FIG. 7 is a longitudinal cross sectional view taken along the line 7—7 of FIG. 6.

Referring now to FIGS. 6 and 7, a static-conductive strap in accordance with a second embodiment of the present invention is shown generally at 10', wherein like elements to the first embodiment are numbered alike. Strap 10' includes an elongated resilient strip 32. Strip 32 is the same as strip 12 of the first embodiment except that strip 32 is not required to be electrically conductive. A fabric sleeve 34 or tube covers strip 32 and is closed at each end to completely encloses strip 32. One or both ends of sleeve 34 may be open providing sleeve 34 is otherwise secured to strip 32 (e.g., by an adhesive). A top surface 36 of sleeve 34 is electrically non-conductive while a bottom surface 38 is electrically conductive. Surface 38 of sleeve 34 has electrically conductive fibers (e.g., silver fibers, stainless steel fibers, or carbon fibers) interwoven with the fabric of sleeve 34. Alternatively, the fabric of surface 38 may be treated with an electrically conductive ink. Preferably, sleeve 34 comprises a resilient knit or woven fabric of polyester fibers. The ends of sleeve 34 may be sealed by an appropriate means, e.g. by heat, ultrasonic welding, adhesive, stitches, or ties so that the seal provides a seam strength of 15 pounds or greater. Strap 10' further includes a snap connector 22 secured in an aperture 20, commonly referred to as an eyelet. Connector 22 is in contact with the conductive fibers of sleeve 34 at an area designated 23. The operation and use of strap 10' is otherwise the same as strap 10 of the first embodiment.

Figure 8:
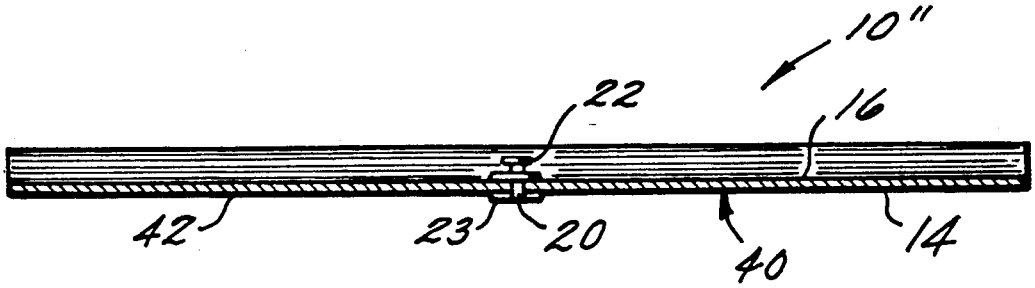
FIG. 8 is a longitudinal cross sectional view of a static-conductive strap in a self supporting axially extending position, in accordance with a third embodiment of the present invention.

Referring now to FIG. 8, a static-conductive strap in accordance with a third embodiment of the present invention is shown generally at 10", wherein like elements to the first embodiment are numbered alike. Strap 10" includes an elongated resilient strip 40. Strip 40 is the same as strip 12 of the first embodiment except that strip 40 is not electrically conductive. Strip 40 has a bottom surface 14 and a top surface 16. The bottom surface 14 is coated with a layer 42 of a known electrically conductive ink. An aperture 20 formed through strip 40 provides means for attaching a snap connector 22. Connector 22 is electrically conductive and is in contact with layer 42 on surface 16 at a circular area designated 23. The operation and use of strap 10'' is otherwise the same as strap 10 of the first embodiment.

A fabric covered coilable strip per se used as a novelty toy item and sold under the trademark "SLAP WRAPS" by Main Street Toy Company is known and constitutes prior art. The present invention (i.e., strap 10, 10', 10'') thus comprises the novel combination of strip 12, 32, 40 having a snap connector 22 (connector 22 for connection to a suitable ground by cord 28), a top surface 26, 34 and 16 which is electrically non-conductive and a bottom surface 24, 38, 42 which is electrically conductive, wherein the bottom surface 24, 38, 42 is intended to come into contact with the wearer's skin, and whereby static electrical charge built-up on the wearer is prevented and discharged to the ground by strap 10, 10', 10''.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A static-conductive strap comprising:

spring means convertible between a spirally coiled configuration and a self supported axially extended configuration, said spring means having opposed top and bottom surfaces, said spring means being electrically conductive;

cover means for covering said top surface of said spring means, said cover means being electrically non-conductive; and electrical connector means being disposed on said cover means and being in electrical contact with said bottom surface of said spring means, said connector means being electrically conductive.

2. The static-conductive strap of claim 1 wherein said spring means comprises an elongated resilient strip of substantially uniform width and thickness.

3. The static-conductive strap of claim 2 wherein said spirally coiled configuration of said strip is coiled on itself in a spiral configuration and, in a transverse cross section of a turn of said strip in a coiled position, said strip exhibits a rectilinear profile wherein said top and bottom surface of said strip are each subsequently flat.

4. The static-conductive strap of claim 3 wherein in said self supported axially extended configuration, said strip extends axially and, in a transverse cross sectional view of said strip in an axially extended position, said strip exhibits a curvilinear profile wherein said bottom surface exhibits a convex profile and said top surface exhibits a concave profile.

5. The static-conductive strap of claim 4 wherein said strip contracts from said axially extended position into said coiled position when said strip in said axially extended position is compressed at a point along the length thereof so that the cross sectional profile of said strip at said point approaches said rectilinear profile.

6. The static-conductive strap of claim 2 wherein said strip comprises a metal.

7. The static-conductive strap of claim 1 wherein the spring means comprises an elongated resilient metal strip of substantially uniform width and thickness, said strip having said opposed top and bottom surfaces and said strip having an axially extended position wherein:

said strip extends axially and in a transverse cross section view of said strip, said strip exhibits a curvilinear profile wherein said bottom surface exhibits a convex profile and said top surface exhibits a concave profile, and said strip having a coiled position wherein:

said strip is coiled on itself in a spiral configuration and in a transverse cross sectional view of said strip, said strip exhibits substantially a rectilinear profile wherein said bottom and top surfaces each exhibits a substantially flat profile.

8. The static-conductive strap of claim 1 wherein said cover means comprises a plastic sheath.

9. The static-conductive strap of claim 1 wherein said connector means comprises a snap connector.

10. A static-conductive strap comprising:

spring means for converting between a spirally coiled configuration and a self supported axially extended configuration, said spring means having opposed top and bottom surfaces;

sleeve means for covering said spring means, said sleeve means comprising electrically non-conductive material along said top surface of said spring means, said sleeve means comprising electrically conductive material along said bottom surface of said spring means; and electrical connector means being disposed on said sleeve means at said top surface and being in electrical contact with said sleeve means at said bottom surface, said connector means being electrically conductive.

11. The static-conductive strap of claim 10 wherein said spring means comprises an elongated resilient strip of substantially uniform width and thickness.

12. The static-conductive strap of claim 11 wherein said spirally coiled configuration of said strip is coiled on itself in a spiral configuration and, in a transverse cross section of a turn of said strip in a coiled position, said strip exhibits a rectilinear profile wherein said top and bottom surface of said strip are each subsequently flat.

13. The static-conductive strap of claim 12 wherein in said self supported axially extended configuration, said strip extends axially and, in a transverse cross sectional view of said strip in an axially extended position, said strip exhibits a curvilinear profile wherein said bottom surface exhibits a convex profile and said top surface exhibits a concave profile.

14. The static-conductive strap of claim 13 wherein said strip contracts from said axially extended position into said coiled position when said strip in said axially extended position is compressed at a point along the length thereof so that the cross sectional profile of said strip at said point approaches said rectilinear profile.

15. The static-conductive strap of claim 11 wherein said strip comprises a metal.

16. The static-conductive strap of claim 10 wherein the spring means comprises an elongated resilient metal strip of substantially uniform width and thickness, said strip having said opposed top and bottom surfaces and said strip having an axially extended position wherein:

said strip extends axially and in a transverse cross section view of said strip, said strip exhibits a curvilinear profile wherein said bottom surface exhibits a convex profile and said top surface exhibits a concave profile, and said strip having a coiled position wherein:

said strip is coiled on itself in a spiral configuration and in a transverse cross sectional view of said strip, said strip exhibits substantially a rectilinear profile wherein said bottom and top surfaces each exhibits a substantially flat profile.

17. The static-conductive strap of claim 16 wherein the sleeve means comprises a fabric tube.

18. The static-conductive strap of claim 10 wherein said sleeve means at said bottom surface of said spring means includes electrically conductive fibers interwoven therewith.

19. The static-conductive strap of claim 18 wherein said electrically conductive fibers comprise silver fibers.

20. The static-conductive strap of claim 18 wherein said electrically conductive fibers comprise stainless steel fibers.

21. The static-conductive strap of claim 18 wherein said electrically conductive fibers comprise carbon fibers.

22. The static-conductive strap of claim 10 wherein said sleeve means at said bottom surface of said spring means includes fibers treated with an electrically conductive ink.

23. The static-conductive strap of claim 10 wherein said connector means comprises a snap connector.

24. A static-conductive strap comprising:

spring means convertible between a spirally coiled configuration and a self supported axially extended configuration, said spring means having opposed top and bottom surfaces, said spring means being electrically non-conductive;

an electrically conductive layer being deposited on said bottom surface;

electrical connector means being disposed on said cover means and being in electrical contact with said electrically conductive layer, said connector means being electrically conductive.

25. The static-conductive strap of claim 24 wherein said spring means comprises an elongated resilient strip of substantially uniform width and thickness.

26. The static-conductive strap of claim 25 wherein said spirally coiled configuration of said strip is coiled on itself in a spiral configuration and, in a transverse cross section of a turn of said strip in a coiled position, said strip exhibits a rectilinear profile wherein said top and bottom surface of said strip are each subsequently flat.

27. The static-conductive strap of claim 26 wherein in said self supported axially extended configuration, said strip extends axially and, in a transverse cross sectional view of said strip in an axially extended position, said strip exhibits a curvilinear profile wherein said bottom surface exhibits a convex profile and said top surface exhibits a concave profile.

28. The static-conductive strap of claim 27 wherein said strip contracts from said axially extended position into said coiled position when said strip in said axially extended position is compressed at a point along the length thereof so that the cross sectional profile of said strip at said point approaches said rectilinear profile.

29. The static-conductive strap of claim 24 wherein the spring means comprises an elongated resilient metal strip of substantially uniform width and thickness, said strip having said opposed top and bottom surfaces and said strip having an axially extended position wherein:

said strip extends axially and in a transverse cross section view of said strip, said strip exhibits a curvilinear profile wherein said bottom surface exhibits a convex profile and said top surface exhibits a concave profile, and said trip having a coiled position wherein:

said strip is coiled on itself in a spiral configuration and in a transverse cross sectional view of said strip, said strip exhibits substantially a rectilinear profile wherein said bottom and top surfaces each exhibits a substantially flat profile.

30. The static-conductive strap of claim 24 wherein said connector means comprises a snap connector.

31. The static-conductive strap of claim 24 wherein said electrically conductive layer comprises an electrically conductive ink.

* * * * *